US006832434B2

(12) United States Patent
Rausch et al.

(10) Patent No.: US 6,832,434 B2
(45) Date of Patent: Dec. 21, 2004

(54) METHODS OF FORMING THERMAL INK JET RESISTOR STRUCTURES FOR USE IN NUCLEATING INK

(75) Inventors: John B. Rausch, Boise, ID (US); David A. Shade, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 75 days.

(21) Appl. No.: 10/336,577

(22) Filed: Jan. 3, 2003

(65) Prior Publication Data

US 2003/0132989 A1 Jul. 17, 2003

Related U.S. Application Data

(62) Division of application No. 09/839,828, filed on Apr. 20, 2001, now Pat. No. 6,527,378.

(51) Int. Cl.[7] ..... H05B 3/00

(52) U.S. Cl. ..... 29/611; 29/610.1; 29/620; 29/846; 361/58; 347/58; 347/62; 347/67

(58) Field of Search ..... 29/611, 610.1, 29/620, 846; 361/58; 347/58, 62, 67

(56) References Cited

U.S. PATENT DOCUMENTS

| | | | | |
|---|---|---|---|---|
| 4,251,824 A | | 2/1981 | Hara et al. | |
| 4,695,853 A | | 9/1987 | Hackleman et al. | |
| 4,870,433 A | * | 9/1989 | Campbell et al. | 347/62 |
| 4,894,664 A | | 1/1990 | Tsung Pan | |
| 4,907,020 A | * | 3/1990 | Shiozaki | 347/58 |
| 5,016,023 A | | 5/1991 | Chan et al. | |
| 5,491,502 A | | 2/1996 | Swanson et al. | |
| 5,563,635 A | | 10/1996 | Kneezel et al. | |
| 5,598,191 A | | 1/1997 | Kneezel | |
| 5,610,644 A | | 3/1997 | Timm, Jr. et al. | |
| 5,650,807 A | | 7/1997 | Abe et al. | |
| 5,675,365 A | | 10/1997 | Becerra et al. | |
| 5,706,041 A | | 1/1998 | Kubby | |
| 5,738,799 A | | 4/1998 | Hawkins et al. | |
| 5,751,317 A | | 5/1998 | Peeters et al. | |
| 5,820,771 A | | 10/1998 | Burke et al. | |
| 5,851,412 A | | 12/1998 | Kubby | |
| 5,870,125 A | | 2/1999 | Swanson et al. | |
| 5,883,650 A | | 3/1999 | Figueredo et al. | |
| 5,933,166 A | | 8/1999 | Andrews et al. | |
| 6,003,973 A | | 12/1999 | Kamiyama et al. | |
| 6,019,457 A | | 2/2000 | Silverbrook | |
| 6,527,378 B2 | * | 3/2003 | Rausch et al. | 347/62 |

FOREIGN PATENT DOCUMENTS

| | | |
|---|---|---|
| EP | 0401996 A2 | 12/1990 |
| EP | 0709196 A2 | 5/1996 |
| JP | 6-320735 | 11/1994 |

* cited by examiner

*Primary Examiner*—Carl J. Arbes
*Assistant Examiner*—Tim Phan

(57) ABSTRACT

Methods of forming thermal ink jet resistor structures for use in nucleating ink are described. In one embodiment, the method comprises forming a layer of conductive material over a substrate, and patterning and etching the layer of conductive material effective to form one or more arrays of resistors. Individual arrays comprise multiple, parallel-connected resistor elements and the resistor elements are configured such that failure of any one resistor element will not render its associated resistor array inoperative for nucleating ink. The resistor elements of individual arrays are formed such that collectively, the resistor elements are not independently addressable. Other embodiments are described.

21 Claims, 5 Drawing Sheets

METHODS OF FORMING THERMAL INK JET RESISTOR STRUCTURES FOR USE IN NUCLEATING INK

RELATED APPLICATIONS

This is a divisional application of, and priority is claimed to U.S. patent application Ser. No. 09/839,828, filed on Apr. 20, 2001, now U.S. Pat. No. 6,527,378 the disclosure of which is incorporated by reference herein.

TECHNICAL FIELD

The present invention relates to print heads for thermal ink jet printers and, more particularly, to methods of forming thermal ink jet resistor structures for use in nucleating ink.

BACKGROUND

In the field of thermal ink jet printing, it has become a common practice to provide heater resistors on a common substrate and align these heater resistors with individual ink reservoirs and corresponding ink ejection orifices in an outer nozzle plate. These heater resistors are physically defined and electrically driven by conductive traces which can be photolithographically formed on the surface of a suitable resistor layer material, such as tantalum-aluminum. These heater resistors have been traditionally isolated from the overlying ink reservoirs by dielectric materials such as silicon carbide and silicon nitride. This type of thermal ink jet printhead is described, for example, in the Hewlett Packard Journal, Vol. 36, No. 5, May 1985, incorporated herein by reference.

Consider, for example, FIG. 1 which shows a cross-sectional view of an exemplary ink reservoir and resistor for ejecting ink. Specifically, a substrate 102 such as silicon, supports a number of ink reservoirs 104. Each reservoir is configured to receive ink that is to be ejected. A heater or resistor 106 is disposed within the reservoir, and a passavation layer 107 comprising a dielectric material is formed over the resistor 106. To expel a jet of ink, the heater or resistor is heated rapidly which causes a vapor bubble 108 to form within the ink reservoir 104. This vapor bubble then causes a quantity of ink 110 to be ejected out of the channel and towards a page that is to be printed upon.

One of the problems associated with ink jet printers and, particularly, the resistors that are used as heaters to heat the ink, is that over time, the resistor can begin to work improperly due to defects that are present in the material of the resistor. Improper resistor operation can also be caused by things such as contamination or voids in layers that are either over or under the resistor, and the presence of voids or cavitation damage. Specifically, resistors are typically formed using thin film techniques where a conductive material, such as tantalum aluminum, is deposited over a substrate and etched to form a desired resistor. This layer is a very thin layer. The resistor layer can have material defects in it which, over time and due in large part to the continual heating and cooling of the material, cause the resistor to effectively malfunction, open up or fuse. When the resistor fails to work, ink cannot be ejected from the ink reservoir and, hence, the integrity of the printer in which the resistor resides can be compromised.

SUMMARY

Methods of forming thermal ink jet resistor structures for use in nucleating ink are described.

In one embodiment, a method comprises forming a layer of conductive material over a substrate, and patterning and etching the layer of conductive material effective to form one or more arrays of resistors. Individual arrays comprise multiple, parallel-connected resistor elements and the resistor elements are configured such that failure of any one resistor element will not render its associated resistor array inoperative for nucleating ink. The resistor elements of individual arrays are formed such that collectively, the resistor elements are not independently addressable.

In another embodiment, a method comprises forming a layer of conductive material over a substrate, and forming, from the layer of conductive material, one or more arrays of resistors. Individual arrays comprise multiple, parallel-connected resistor elements and the resistor elements are configured such that failure of any one resistor element will not render its associated resistor array inoperative for nucleating ink. The resistor elements of individual arrays are formed such that collectively, the resistor elements are not independently addressable.

In a further embodiment, a method comprises forming a layer of conductive material over a substrate, where the substrate comprises a material selected from a group of materials comprising: glass, $SiO_2$, $SiO_2$ over silicon, and $SiO_2$ over glass. The method further comprises forming, from the layer of conductive material, one or more arrays of resistors. Individual arrays comprise multiple, parallel-connected resistor elements and the resistor elements are configured such that failure of any one resistor element will not render its associated resistor array inoperative for nucleating ink. The resistor elements of individual arrays are formed such that collectively, the resistor elements are not independently addressable.

In another embodiment, a method comprises forming a layer of conductive material over a substrate, where the substrate comprises a material selected from a group of materials comprising: glass, $SiO_2$, $SiO_2$ over silicon, and $SiO_2$ over glass. The method further comprises forming a masking layer over the substrate, patterning the masking layer to form one or more resistor array patterns, and etching the layer of conductive material through the patterned masking layer effective to form one or more arrays of resistors. Individual arrays comprise multiple, parallel-connected resistor elements. The resistor elements are configured such that failure of any one resistor element will not render its associated resistor array inoperative for nucleating ink. The resistor elements of individual arrays are formed such that collectively, the resistor elements are not independently addressable.

In yet another embodiment, a method comprises forming a first resistor element over a substrate and forming at least one other resistor element over the substrate and operably connected in parallel with the first resistor element. The resistor elements are formed for redundancy such that if one of the resistor elements fails, one or more remaining resistor elements can function to effectuate ink ejection. The resistor elements are formed such that they are not independently addressable.

DETAILED DESCRIPTION

Overview

In accordance with the described embodiments, redundant ink jet resistor arrays are provided. Each ink reservoir that contains ink for injection is provided with one resistor array to nucleate the ink or provide the vapor bubble. Each resistor array comprises multiple resistors that are connected in parallel. The parallel resistors have substantially the same resistance. The resistor array is the only resistive structure that is utilized for ejecting ink. To eject ink, voltage pulses of a prescribed magnitude are applied to the resistor array to effectively heat the ink to form the vapor bubble. The resistor arrays preclude redistribution of current caused by a local defect, particle or void as would happen in the case of a single resistor. In the event that one of the resistors of the array fails, the other parallel resistors can continue to operate to eject ink.

Figure 9:
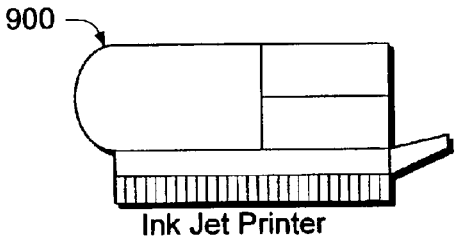
FIG. 9 is a view of a printer with which the various inventive principles can be utilized.

For additional background information in ink jet printers, the reader is referred to U.S. Pat. Nos. 5,016,023, 5,610,644, 5,870,125, 4,695,853, and 5,491,502, the disclosures of which are incorporated by reference herein. An exemplary ink jet printer in which the various embodiments can be implemented is shown in FIG. 9 at 900.

Exemplary Embodiment

Figure 1:
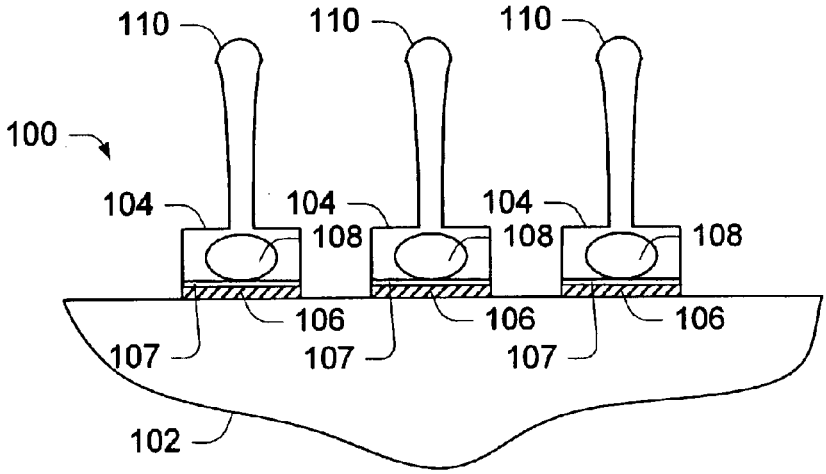
FIG. 1 is a cross-sectional view of an exemplary ink jet reservoir employing resistors for nucleating an amount of ink for ejection.
Figure 2:
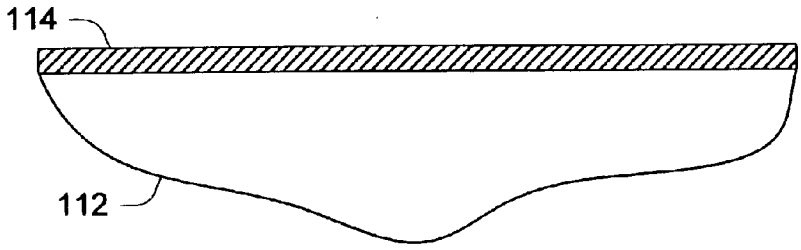
FIG. 2 is a cross-sectional view of a substrate fragment in process in accordance with one embodiment.

Referring to FIG. 2, a substrate fragment is shown at 112 and comprises the substrate upon which the resistor arrays are to be formed. Substrate 112 can comprise any suitable material. In the illustrated and described embodiment, the substrate can comprise glass, $SiO_2$, $SiO_2$ over Si, or $SiO_2$ over glass. A conductive layer 114 is formed over substrate 112 and comprises material from which the resistor arrays are to be formed. Any suitable conductive material can be used. In the illustrated and described embodiment, layer 114 comprises a tantalum aluminum material that is typically used to form ink jet heater/resistor elements. Other suitable conductive materials include, without limitation, refractory materials such as refractory material alloys. In the discussion that follows, the resistor array formation process is described with respect to one resistor array comprising multiple resistors. It is to be understood that elsewhere on the substrate other resistor arrays are contemporaneously formed.

Figure 3:
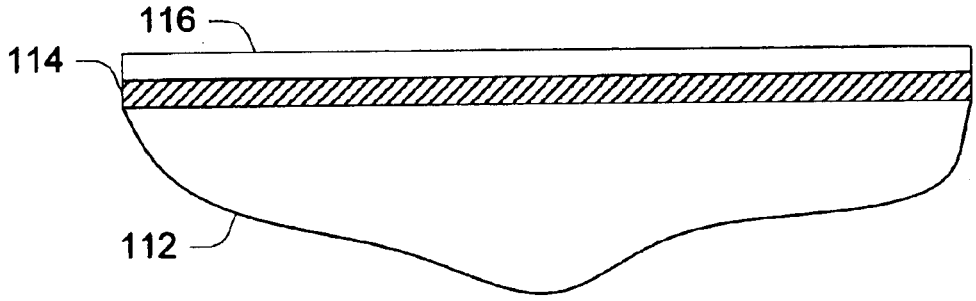
FIG. 3 is a cross-sectional view of the FIG. 2 substrate fragment in process in accordance with one embodiment.

Referring to FIG. 3, a masking layer 116 is formed over conductive layer 114. Any suitable masking layer material can be used. An exemplary material comprises photoresist.

Figure 4:
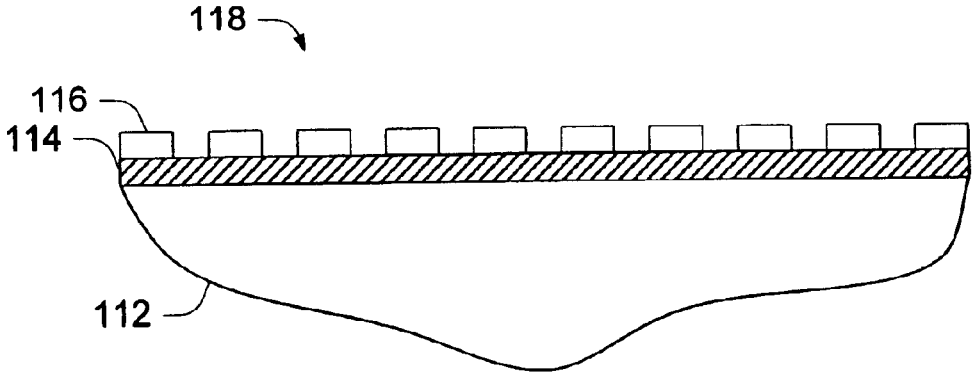
FIG. 4 is a cross-sectional view of the FIG. 3 substrate fragment in process in accordance with one embodiment.

Referring to FIG. 4, masking layer 116 is exposed and patterned to form a resistor array pattern generally indicated at 118. Standard known techniques can be utilized to expose and pattern masking layer 116.

Figure 5:
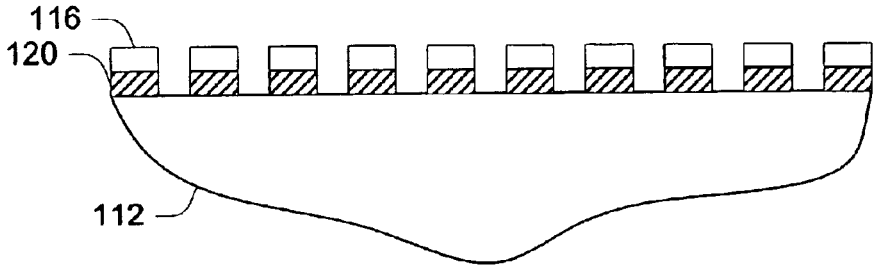
FIG. 5 is a cross-sectional view of the FIG. 4 substrate fragment in process in accordance with one embodiment.
Figure 6:
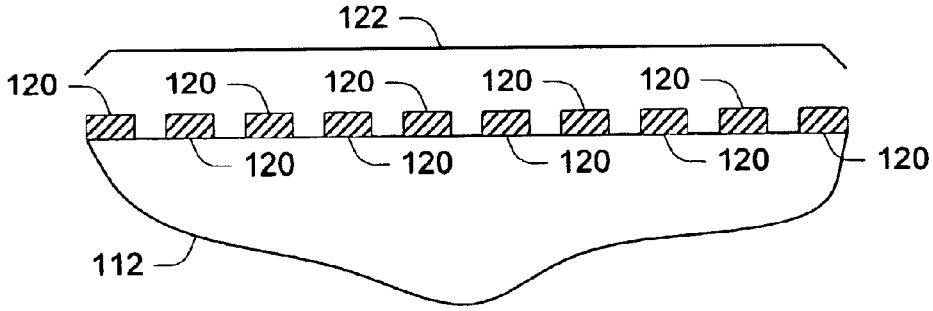
FIG. 6 is a cross-sectional view of the FIG. 5 substrate fragment in process in accordance with one embodiment.

Referring to FIGS. 5 and 6, conductive layer 114 is etched to form a plurality of resistor elements 120. Collectively, the resistors elements are connected in parallel and form one resistor array 122. Advantageously, each of the resistor elements has substantially the same resistance. Any suitable number of resistor elements can be provided. In the illustrated and described embodiment, ten such resistors are shown. Each resistor array comprises the only resistive structure or heater/resistor structure that is utilized to eject ink.

Figure 7:
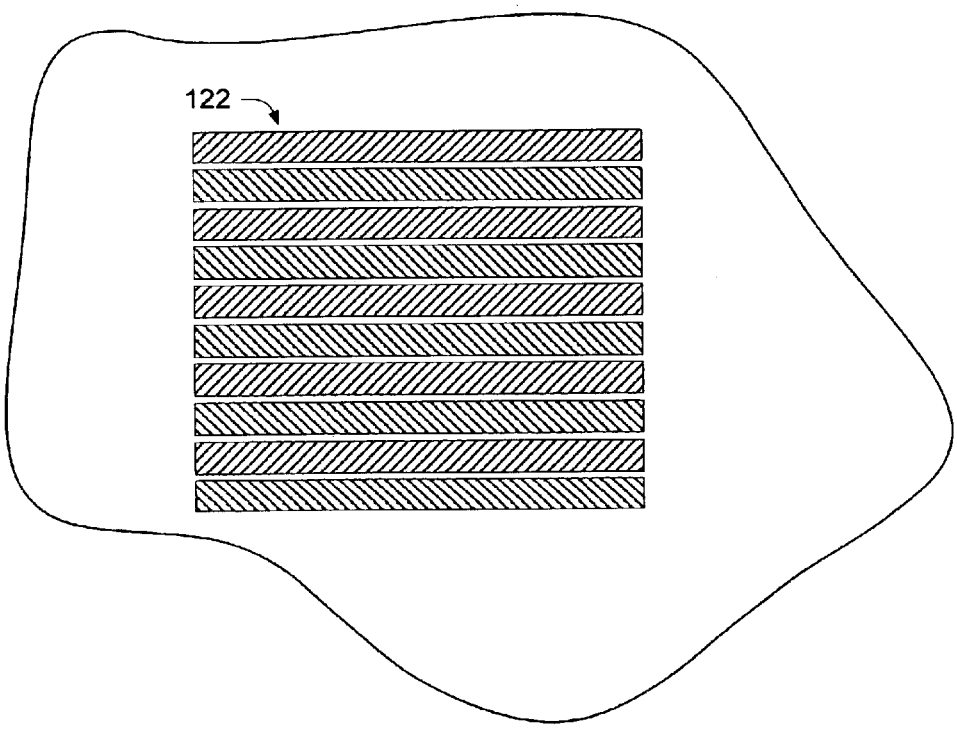
FIG. 7 is a top plan view of the FIG. 6 substrate fragment.

Referring to FIG. 7, a top plan view of resistor array 122 is shown. The individual resistors of the array are isolated from one another except at conductor junctions that are not specifically illustrated.

Figure 8:
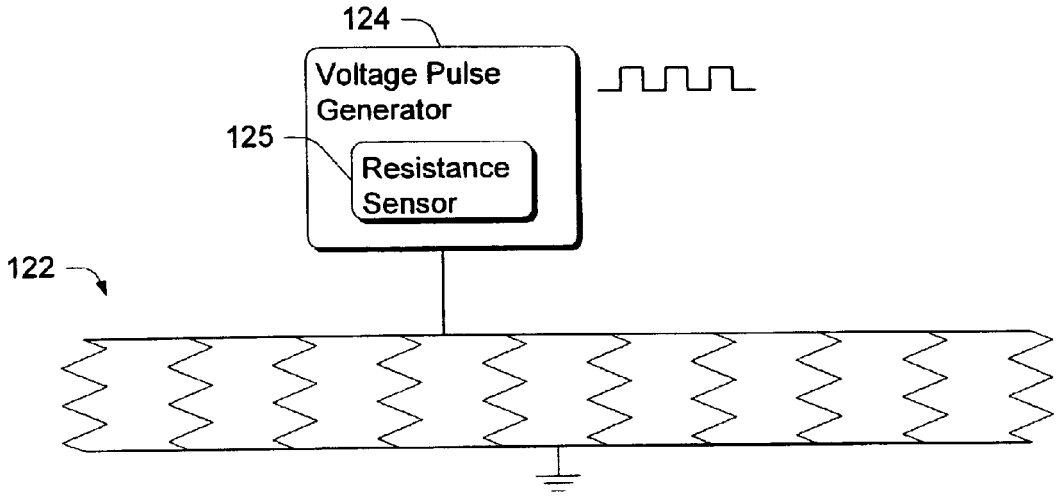
FIG. 8 is a schematic view of an exemplary resistor array comprising multiple redundant resistor elements in accordance with one described embodiment.

FIG. 8 is an electrical schematic diagram of one exemplary resistor array configured for use in connection with an ink reservoir to eject ink. To eject ink, a series of voltage pulses are generated by a pulse generator 124 and applied to the resistor array. In the event that one or more of the resistors fails, the other parallel-connected resistors can still function to nucleate the ink thus causing it to eject. In an alternate embodiment, the voltage pulse generator can include a resistance sensor 125. The purpose of the resistance sensor 125 is to sense the resistance of the multiple parallel resistors. In the event that one or more of the resistors fails, the overall resistance of the parallel array of resistors changes. Upon sensing a change in the overall resistance of the resistors, the voltage pulse generator can then modify the power input or voltage pulses that is (are) delivered to the resistor array.

The present embodiments constitute improvements over past ink jet resistor constructions in that now, a redundant array of multiple resistors is provided. The failure of one or more of the individual resistor elements will not necessarily mean failure of the individual ejector structure of which the array comprises a part. Further, use of the described voltage pulses in connection with the multiple parallel resistors will ensure that any remaining resistor elements (after loss of one or more elements), will not be excessively over-stressed.

The inventor is aware of one particular resistor construction that uses a pair of so-called converters for converting electrical energy to heat energy, and a so-called distributor to distribute or dissipate the heat energy created by the converters. Such is described in U.S. Pat. No. 5,933,166. The presently-described embodiments are different from this construction and provide advantages that are not embodied in the construction. For example, in the present example, all of the multiple resistor elements are essentially the same in construction, material, resistivity and the like. This similarity enhances the resistor array's advantageous redundant characteristics. The construction described in the '166 patent does not have resistors that are redundant. In addition, failure of one of the converters or the distributor will render the system useless for ejecting ink.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. A method of forming a thermal ink jet resistor structure for use in nucleating ink, the method comprising:

forming a layer of conductive material over a substrate; and patterning and etching the layer of conductive material effective to form one or more arrays of resistors, individual arrays comprising multiple, parallel-connected resistor elements each capable of heating ink, each individual array being associated with a respective ink reservoir, the resistor elements of the individual arrays being configured such that failure of any one resistor element will not render its associated resistor array inoperative for nucleating ink within the respective ink reservoir.

2. The method of claim 1, wherein said forming of the layer of conductive material comprises forming tantalum aluminum over the substrate.

3. The method of claim 1, wherein said forming of the layer of conductive material comprises forming a refractory material over the substrate.

4. The method of claim 1, wherein said patterning and etching comprises forming the only resistor structures that are utilized for nucleating ink.

5. The method of claim 1, wherein said patterning and etching comprises forming the resistor elements to have substantially the same resistances.

6. A method of forming a thermal ink jet resistor structure for use in nucleating ink, the method comprising:

forming a layer of conductive material over a substrate; and forming, from the layer of conductive material, one or more arrays of resistors, individual arrays comprising multiple, parallel-connected resistor elements each capable of heating ink, each individual array being with a respective ink reservoir, the resistor elements of individual arrays being configured such that failure of any one resistor clement will not render its associated resistor array inoperative for nucleating ink within the respective ink reservoir, the resistor elements of individual arrays further being formed such that collectively, the resistor elements are not independently addressable.

7. The method of claim 6, wherein said forming of the layer of conductive material comprises forming tantalum aluminum over the substrate.

8. The method of claim 6, wherein said forming of the layer of conductive material comprises forming a refractory material over the substrate.

9. The method of claim 6, wherein said forming one or more arrays comprises forming the resistor elements to have substantially the same resistances.

10. A method of forming a thermal ink jet resistor structure for use in nucleating ink, the method comprising:

forming a layer of conductive material over a substrate, the substrate comprising a material selected from a group of materials comprising: glass, $SiO_2$, $SiO_2$ over silicon, and $SiO_2$ over glass; and forming, from the layer of conductive material, one or more arrays of resistors, individual arrays comprising multiple, parallel-connected resistor elements, individual arrays being associated with individual ink reservoirs, the resistor elements of individual arrays being configure such that failure of any one resistor element will not render its associated resistor array inoperative for nucleating ink within an associated ink reservoir, the resistor elements of individual arrays further being formed such that collectively, the resistor elements are not independently addressable.

11. The method of claim 10, wherein said forming of the layer of conductive material comprises forming tantalum aluminum over the substrate.

12. The method of claim 10, wherein said forming of the layer of conductive material comprises forming a refractory material over the substrate.

13. The method of claim 10, wherein said forming one or more arrays comprises forming the resistor elements to have substantially the same resistances.

14. A method of forming a thermal ink jet resistor structure for use in nucleating ink, the method comprising:

forming a layer of conductive material over a substrate, the substrate comprising a material selected from a group of materials comprising: glass, $SiO_2$, $SiO_2$ over silicon, and $SiO_2$ over glass;

forming a masking layer over the substrate;

patterning the masking layer to form one or more resistor array patterns;

etching the layer of conductive material through the patterned masking layer effective to form one or more arrays of resistors, individual arrays comprising multiple, parallel-connected resistor elements, individual arrays being associated with individual ink reservoirs, the resistor elements of individual arrays being configured such that failure of any one resistor element will not render its associated resistor array inoperative for nucleating ink from an associated reservoir, the resistor elements of individual arrays further being formed such that collectively, the resistor elements are not independently addressable.

15. The method of claim 14, wherein said forming of the layer of conductive material comprises forming tantalum aluminum over the substrate.

16. The method of claim 14, wherein said forming of the layer of conductive material comprises forming a refractory material over the substrate.

17. The method of claim 14, wherein said forming one or more arrays comprises forming the resistor elements to have substantially the same resistances.

18. A method of forming a thermal ink jet resistor structure comprising:

forming a first resistor element over a substrate; and forming at least one other resistor element over the substrate and operably connected in parallel with the first resistor element, the first and one other resistor elements being formed for redundancy such that if one of the resistor elements fails, one or more remaining resistor elements can function to effectuate ink ejection from an individual reservoir; and the resistor elements being formed such that they are not independently addressable.

19. The method of claim 18, wherein said forming of the resistor elements comprises forming the resistor elements from the same material.

20. The method of claim 18 wherein said forming of the resistor elements comprises forming the resistor elements from tantalum aluminum.

21. The method of claim 18, wherein said forming of the resistor elements comprises forming the resistor elements from a refractory material.

* * * * *